US007246915B2

(12) United States Patent
Verona

(10) Patent No.: US 7,246,915 B2
(45) Date of Patent: Jul. 24, 2007

(54) RECEPTACLE ILLUMINATING DEVICE

(76) Inventor: Steven N. Verona, 6206 Olde Orchard Dr., Columbus, OH (US) 43213

( * ) Notice: Subject to any disclaimer, the term of this patent is extended or adjusted under 35 U.S.C. 154(b) by 130 days.

(21) Appl. No.: 10/871,306

(22) Filed: Jun. 18, 2004

(65) Prior Publication Data

US 2005/0281019 A1 Dec. 22, 2005

(51) Int. Cl.
*A45C 15/06* (2006.01)

(52) U.S. Cl. ..... 362/156; 362/84; 362/103

(58) Field of Classification Search ..... 362/154–156, 362/84, 103, 105, 106
See application file for complete search history.

(56) References Cited

U.S. PATENT DOCUMENTS

| | | | | |
|---|---|---|---|---|
| 1,116,276 | A | 11/1914 | Hoffman et al. | |
| 2,218,396 | A | 10/1940 | Hallbauer | |
| 2,334,480 | A | 11/1943 | Cross | |
| 3,808,416 | A | 4/1974 | Pottratz | |
| 4,015,112 | A | 3/1977 | Castaldo | |
| 4,144,557 | A | 3/1979 | Kerr, III et al. | |
| 4,210,953 | A | 7/1980 | Stone | |
| 4,376,935 | A | 3/1983 | Castaldo | |
| 4,864,473 | A * | 9/1989 | Tokarz | 362/490 |
| 4,912,611 | A | 3/1990 | Lyle | |
| 4,954,934 | A | 9/1990 | Kidder et al. | |
| 4,972,304 | A | 11/1990 | Ylla | |
| 5,005,111 | A | 4/1991 | Teal | |
| 5,067,063 | A * | 11/1991 | Granneman et al. | 362/156 |
| D332,839 | S | 1/1993 | Beckner, Jr. | |
| 5,424,926 | A | 6/1995 | Myers | |
| 5,444,605 | A | 8/1995 | Rivera | |
| 5,475,574 | A | 12/1995 | Chien | |
| 5,485,355 | A | 1/1996 | Voskoboinik et al. | |
| 5,676,451 | A * | 10/1997 | Tabanera | 362/156 |
| 5,709,448 | A | 1/1998 | Jennings et al. | |
| 5,794,366 | A * | 8/1998 | Chien | 40/540 |
| 5,833,352 | A | 11/1998 | Boodwin | |
| 5,894,686 | A * | 4/1999 | Parker et al. | 36/137 |
| 5,934,790 | A | 8/1999 | Quintana et al. | |
| 6,082,867 | A | 7/2000 | Chien | |
| 6,152,572 | A | 11/2000 | Cutler | |
| 6,260,985 | B1 | 7/2001 | Zeller | |
| 6,340,235 | B1 | 1/2002 | Bryan | |
| 6,447,142 | B1 | 9/2002 | Weir | |
| 6,508,568 | B1 | 1/2003 | Blue-Recio | |
| 6,511,214 | B1 | 1/2003 | Parsons et al. | |
| 6,582,093 | B1 | 6/2003 | Branaugh et al. | |
| 6,585,390 | B2 | 7/2003 | Stone et al. | |
| 2004/0090773 | A1 * | 5/2004 | Bryan | 362/156 |

* cited by examiner

*Primary Examiner*—Renee Luebke
*Assistant Examiner*—Gunyoung T. Lee
(74) *Attorney, Agent, or Firm*—Jason H. Foster; Kremblas, Foster, Phillips & Pollick

(57) ABSTRACT

An illuminating device for an enclosed receptacle, such as a purse or handbag. Because it is difficult to see the contents of a purse due to darkness, the invention includes a light-emitting membrane electrically connected to a power supply and a switch. Actuation of the switch turns the membrane on to illuminate the interior of the purse. The membrane also has a backbone, such as a pair of malleable wires, mounted to it, such as by double-sided tape. The wires, upon bending of the membrane and wires to conform to the interior shape of the purse, retain their deformed shape, and maintain the membrane at the deformed shape. The opposite side of the double-sided tape preferably adheres the membrane and backbone to the interior of the purse or other receptacle.

9 Claims, 3 Drawing Sheets

RECEPTACLE ILLUMINATING DEVICE

BACKGROUND OF THE INVENTION

1. Field of the Invention

This invention relates generally to a device for illuminating the interior of a portable receptacle, such as a purse, backpack, attache or other luggage.

2. Description of the Related Art

It is well known to illuminate the interiors of bags, such as purses. However, conventional illuminating devices normally have a single source of light, such as a light bulb, which means that the lighting is at best uneven, and can be blocked easily by a single object. A light source emanating from a single point creates shadows, and thereby defeats the purpose or hinders the effectiveness of a light intended to make it easier to see inside the bag.

An illuminating device shown in U.S. Pat. No. 5,067,063 to Granneman, et al., uses an illuminating panel, but the panel is typically rigid and is built into the bag or placed in a pocket in the side of the bag. This fails to sufficiently illuminate the interior of the bag, and requires additional structures in the bag.

The need exists for a receptacle illuminating device that is easily retrofitted to receptacles such as purses, and that illuminates more of the bag than conventional lights illuminate.

BRIEF SUMMARY OF THE INVENTION

The invention is an illuminating apparatus for illuminating a substantially enclosed receptacle, such as a purse or other portable luggage item. The apparatus comprises a flexible, light-emitting membrane and a backbone mounted to the membrane. The backbone retains a deformed shape and maintains the membrane at the deformed shape so that when the membrane and backbone are deformed to the contour of the interior of a purse or other receptacle, they retain that shape and make the illuminating device less obtrusive and more effective.

The illuminating apparatus preferably includes a power supply and switch electrically connected to the membrane. The membrane also preferably includes mounting means for mounting the membrane and backbone to the receptacle. An example of such mounting means is double-sided tape.

In a preferred embodiment, the backbone comprises at least one malleable elongated metal body, such as wire or strip, and the double-sided tape is mounted on a major surface of the membrane and extend across the metal body.

The invention also contemplates a method of mounting a membrane and backbone to the receptacle. One advantage of the present invention is that it illuminates the interior of the receptacle from the major surface of the membrane, not just from one point. Furthermore, the flexible membrane and deformable backbone can be deformed to a shape that conforms to the interior surface of the receptacle, and will retain that shape. And because the membrane can be bent to sit at the bottom and/or along the sides of the purse, it shines light from many directions, not just one. This makes the invention a superior illuminating device for purses, backpacks and other luggage receptacles.

Figure 1:
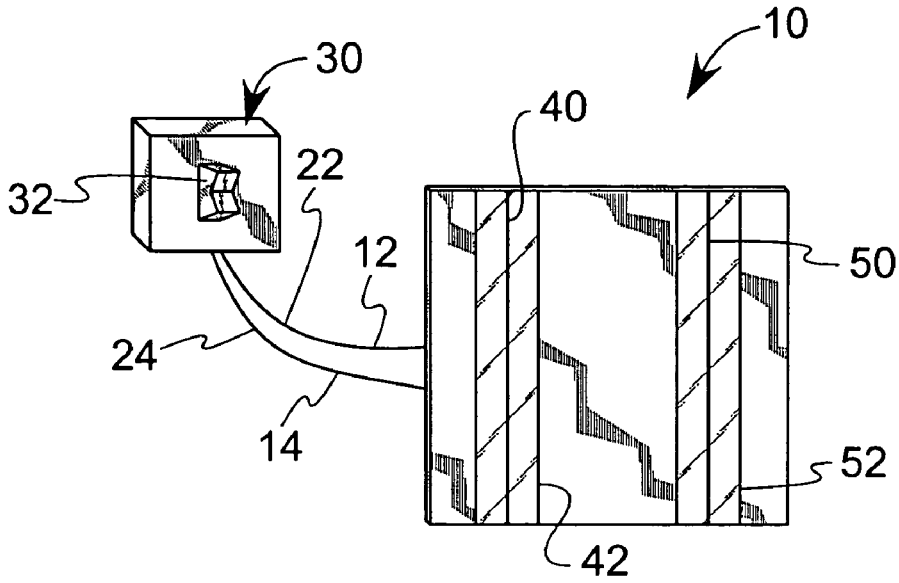
FIG. 1 is a view in perspective illustrating the preferred embodiment of the present invention.

In describing the preferred embodiment of the invention that is illustrated in the drawings, specific terminology will be resorted to for the sake of clarity. However, it is not intended that the invention be limited to the specific term so selected and it is to be understood that each specific term includes all technical equivalents that operate in a similar manner to accomplish a similar purpose. For example, the word connected or terms similar thereto are often used. They are not limited to direct connection, but include connection through other elements where such connection is recognized as being equivalent by those skilled in the art.

DETAILED DESCRIPTION OF THE INVENTION

The invention, shown in FIG. 1, includes a planar membrane 10 that illuminates upon the application of an electrical voltage thereto. Such membranes are commonly referred to as electroluminescent lamps, but any flexible (by human hands) light-emitting material, including chemical-reaction driven and other non-electrical membranes, will suffice.

The planar membrane 10 is electrically connected to the electrodes 12 and 14 to which the wires 22 and 24, respectively, are electrically connected. The wires 22 and 24 extend from the electrodes to a case 30 that houses an electrical power source, which is preferably a conventional 9-volt or other suitable battery, and a conventional inverter (not visible) for converting the direct electrical current supplied by the battery to alternating current. Of course, an inverter is not required if the power source supplies alternating current. The case 30 has a rocker switch 32 that is electrically interposed between the battery and the wires 22 and 24 in a conventional manner to electrically connect the positive and negative terminals of the battery to the wires 22 and 24, thereby inducing a voltage across the electrodes 12 and 14. Upon switching the switch 32 to the "on" position, a voltage is induced across the electrodes 12 and 14. Upon switching the switch 32 to the "off" position, no voltage is induced across the electrodes 12 and 14. Thus, one can manually turn the illuminating membrane 10 on and off by the rocker switch 32.

Although the membrane 10 is substantially planar, most purses and other portable receptacles have interior surfaces that are not planar. For example, most purses have a curved sidewall made of leather, simulated leather or fabric. Furthermore, most illuminating membranes are flexible, but are made of polymeric materials with "memory", meaning that when they are deformed, they do not retain their deformed shape. Instead, the polymeric chains stretch when the membrane is deformed, but retract upon removal of the deforming force, and return the material to the original, substantially planar shape.

The membrane 10 is mounted to a backbone, such as the wires 40 and 50, that are readily deformable by the human hands. The term "backbone" is a generic term for any rigidifying structure that maintains the membrane in a deformed shape. For example, piano wire, which can be bent into a particular shape, such as a U-shape, is a contemplated backbone for the membrane 10. Piano wire retains its bent shape due to inelastic deformation, which occurs during the deformation of the wires 40 and 50, and work hardening of the wire due to the inelastic deformation. In the embodiment shown in FIG. 1, the wires 40 and 50 are taped to the membrane 10, parallel to one another, by strips of conventional double-sided tape 42 and 52, respectively. Of course, any other means of mounting the backbone material to the membrane 10 will suffice. It will become apparent that the "backbone" can alternatively be a frame that is mounted to the periphery of the membrane, or can be made of wires mounted in such a frame. The number of possible backbone structures is virtually unlimited, and therefore cannot be described exhaustively.

When a deforming force is applied to the membrane 10 and the wires 40 and 50, the wires and membrane bend, and the wires retain substantially their deformed shape even after removal of the deforming force. Although the membrane tends to bias the wires 40 and 50 back to the membrane's 10 original planar shape, the wires 40 and 50 are strong enough to resist the force and maintain the membrane 10 and wires 40 and 50 in their deformed shape.

For example, the membrane 10 can be deformed into the U-shape shown in FIG. 10, and then placed in the interior of the handbag 60, which has a substantially enclosed chamber 68. The sidewall 62 of the handbag 60 is a flexible, soft material, such as fabric or leather, and has a generally U-shaped interior to which the membrane 10 is appropriately contoured. Thus, upon placing the membrane 10 in the handbag 60 and pressing it against the interior surface of the sidewall 62, the membrane 10 seats neatly against the sidewall 62 along the entire curved inner surface of the sidewall. Double-sided tape, adhesive, stitching or any other means for mounting the membrane 10 to the sidewall 62 easily mount the two surfaces together, although such mounting is not required. The membrane 10 can remain unattached or be inserted into a pocket or other structure that is integral with the sidewall of the receptacle. Preferably, the battery, inverter, switch and any other components of the invention are also mounted to the receptacle, although this is not required. Once the membrane is switched on, the majority of the interior of the handbag 60 is flooded with light as shown, preferably coming from more than one side of the purse due to the fact that the membrane conforms to the contour of the bag 60 and extends along more than one side of the bag 60.

Figure 2:
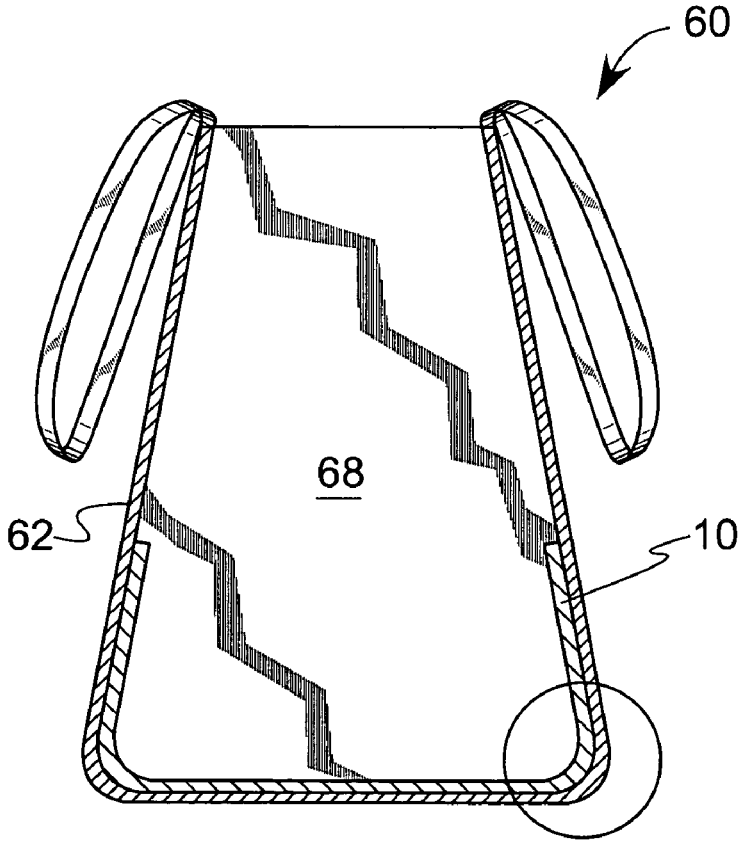
FIG. 2 is a side view in section illustrating a purse in which the present invention is mounted.
Figure 7:
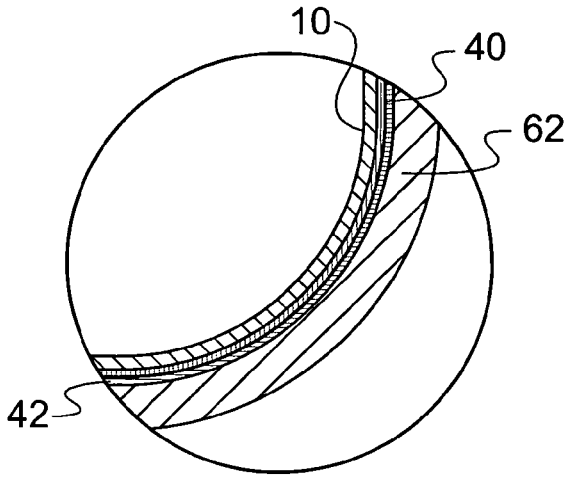
FIG. 7 is an enlarged view in section of the encircled portion of the purse of FIG. 2.

As illustrated in FIG. 7, when the membrane 10 is mounted to the inner surface of the handbag with double-sided tape 42 as shown in FIG. 2, the wires 40 and 50 are sandwiched between the membrane 10 and the purse sidewall 62. This prevents any wire that may work loose from the membrane 10 from cutting the user's hands upon reaching into the purse. Thus, by attaching the membrane in the purse this way, the safety of the device is enhanced.

The wires 40 and 50 are not the only backbone material that can be used. Any material that can be deformed to a shape and then retain substantially that shape while also maintaining the membrane at substantially its deformed shape will suffice as the backbone. Contemplated materials include, but are not limited to, any elongated malleable metal, plastic and/or any other deformable material that retains its shape after being deformed to that shape. One or more strips of inelastically deformable material, such as metal ribbon, can be used instead of the wires 40 and 50. Alternatively, one or more wires or strips can be placed at various places on a membrane, such as all around the edges, crisscrossed or in any pattern desired. A screen or web of inelastically deformable material could be laminated to the back of the membrane. A frame into which the membrane is mounted could be inelastically deformable. In one contemplated embodiment, the backbone is formed by electrically conductive wires that extend between panels of a multiple-panel membrane.

Additionally, the switch is not limited to a rocker panel switch or other similar manually actuated switch. A switch can be used that is activated by motion, a change in thermal energy, opening or closing of the receptacle's lid or other closure, light or the absence thereof, the time of day or any other conventional switching mechanism. Additionally, the switch can be set to operate until turned off manually, or it can be turned off automatically by any of the variables listed herein, or by a particular amount of time passing.

Figure 3:
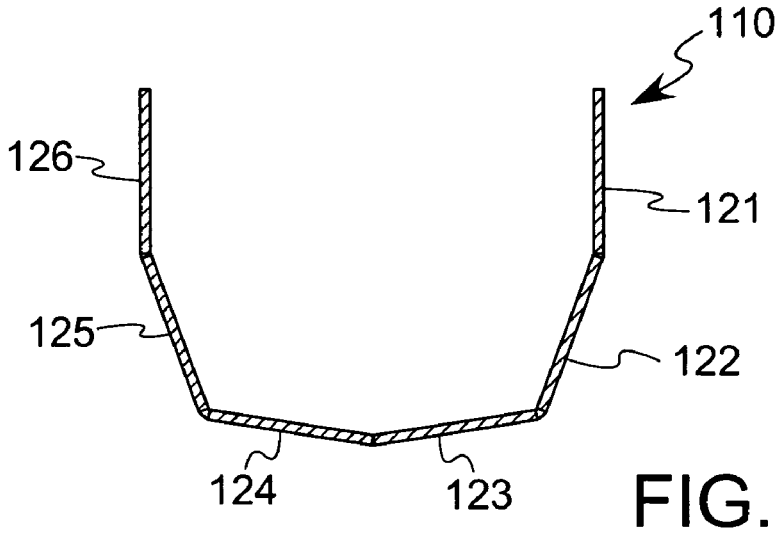
FIG. 3 is a side view in section through the lines 3-3 of FIG. 4

It is possible, instead of using a membrane that includes only a single illuminating panel, to form a membrane of multiple illuminating panels joined at the edges by tape or another connecting means. Such a structure, an example of which is shown in FIG. 3, is still considered a membrane, even though it is made up of separable illuminating lamp panels. The FIG. 3 embodiment is a membrane 110 including six discrete panels 121, 122, 123, 124, 125 and 126 joined at their edges to adjacent panels by transparent tape on the front and back of the panels. The tape forms hinges between the panels 121-126, and permits the membrane 110 to be bent to the position shown in FIG. 3 from its normally substantially planar shape. Preferably, only one inverter, one battery and one switch mount to and power the panels 121-126.

Figure 4:
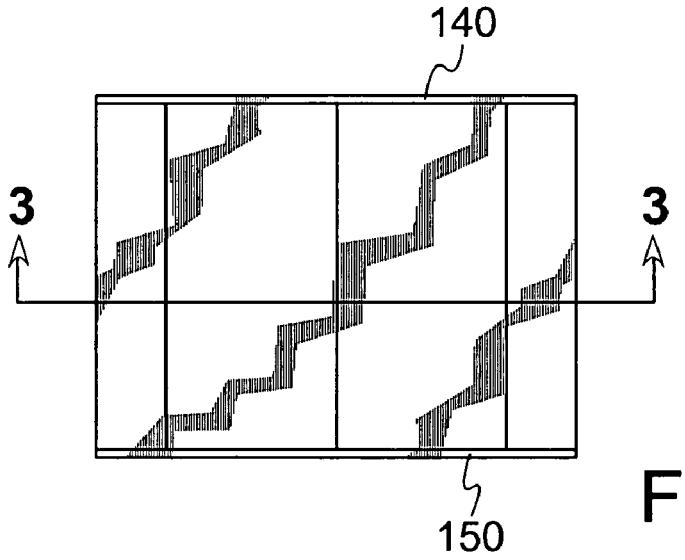
FIG. 4 is a top view illustrating an alternative embodiment of the present invention.

A backbone, such as the wires 140 and 150 aligned in the lateral edges of the membrane 110 (see FIG. 4), maintains the membrane 110 at the deformed shape shown in FIG. 3. The wires 140 and 150 are virtually invisible due to being mounted in the same plane as the panels 121-126 when all panels are coplanar. Thus, the panels 121-126 can be bent to the shape shown in FIG. 3 or any other desirable shape, in order to conform to the shape of the interior of a receptacle, such as a purse. Then the membrane 110 can be placed in the purse, or mounted thereto using double-sided tape, glue or any other mounting means.

It is possible to create gaps between the panels to promote the deformation of the membrane into a curved or other deformed shape. The gaps limit the amount that the panels of the membrane contact one another, and thereby limit the possibility of breakage of the panels. Such gaps can be empty, or spanned by tape or other hinge material. The gaps permit sharper angles of deflection between the panels. Such a structure would be particularly useful in a receptacle having a plurality of compartments, such as the purse 220 shown in FIG. 8. The illuminating device 230 is mounted in the purse 220 along the walls of the interior chamber thereof. For example, the panels, 200, 202, 204, 206, 208, 210 and 212 are connected electrically to one another at hinges at adjacent edges. The panels 200-212 are mounted, such as by double-sided tape, to the portions of the purse 220 they contact for maintaining their relative positions. By extending the panels and hinges over the partition walls of the purse 220, the panels of the illuminating device 230 provide light in all compartments of the purse 220, including the pocket 222. By creating gaps between the panels 200-212, sharper angles can be formed between the panels 200-212, and therefore a multi-compartment purse 220 can be effectively illuminated by actuating the switch 216 on the power unit 214 attached to the purse 220. The backbone members (not visible) in the illuminating device 230 maintain the shape of the panels 200-212 and the hinges between the panels.

Figure 8:
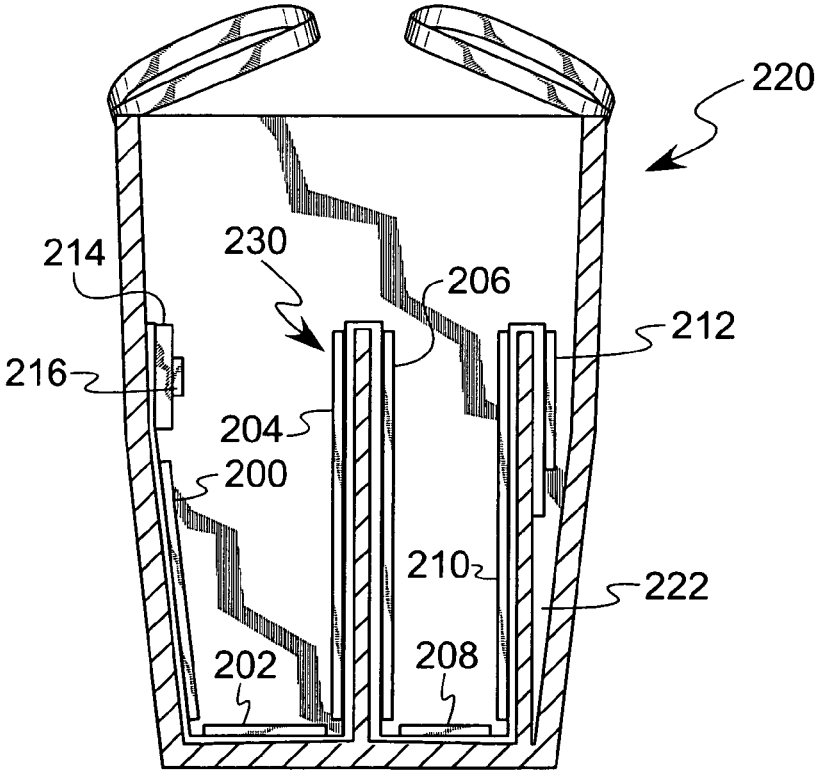
FIG. 8 is a side view in section illustrating an alternative embodiment of the present invention in a purse.

Thus, a multiple-panel membrane, such as the membranes of FIGS. 3 and 8, can have one or more of their panels in multiple parts of the receptacle. For example, a purse with two large pockets can have one, two or more panels of the membrane in one pocket, and one, two or three panels in the other pocket. Likewise, if the purse has one major and one smaller pocket, one panel can be placed in the smaller pocket, and the remaining panels can be placed in the major pockets. The membrane is also advantageously retained in the purse, possibly without tape or glue, by the friction caused by folding the membrane into different pockets.

The panels of a membrane, such as the membrane 110 of FIG. 3, can be electrically connected at adjoining edges in a manner that permits attachment, and also possibly removal, of panels at any time. Thus, the membrane can be a modular device made up of as many illuminating panels as is desired for a particular receptacle. Furthermore, the panels of such a membrane can be added and removed at any time by using electrical and/or mechanical connectors that are removable. It should be noted that if the same power supply is used with multiple panels, the illumination provided by each panel will be diminished when more panels are used. This may be acceptable under some circumstances. However, by increasing the power supplied to the device, one can maintain the same amount of illumination generated by each panel as before any panels were added. Thus, adding panels does not necessarily result in decreased illumination by each panel.

Figure 5:
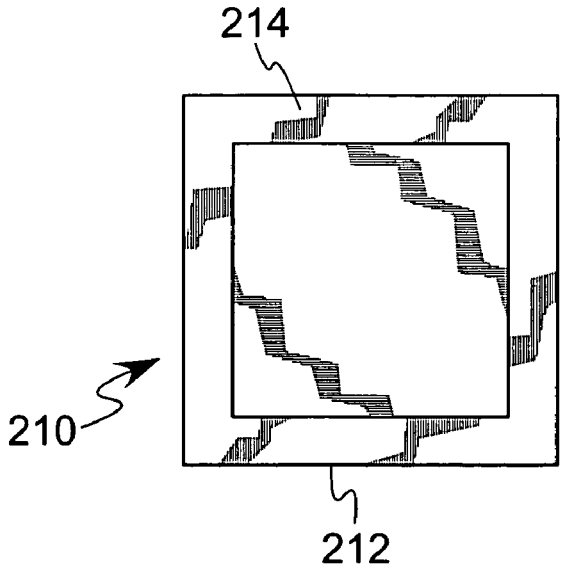
FIG. 5 is a front view illustrating an alternative frame structure for the present invention attached to an embodiment of the invention.
Figure 6:
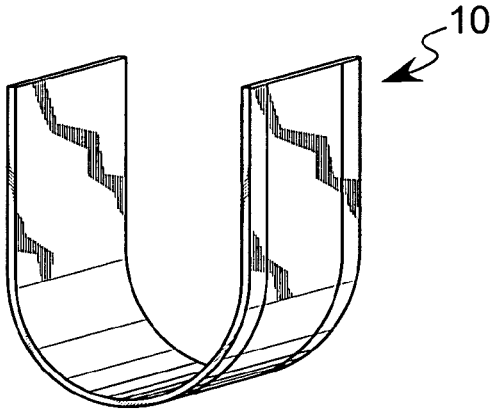
FIG. 6 is a view in perspective illustrating the present invention in a deformed, U-shape.

Another embodiment of the present invention is shown in FIG. 5, in which the membrane 210 includes an electroluminescent lamp panel 212 and a backbone, such as the frame 214. The frame 214 extends around all four sides of the rectangular membrane 210, encloses all edges of the panel 212, and permits convenient attachment of the membrane 210 to the interior of a luggage item, such as a purse or briefcase. The frame 214 can be glued, taped, sewn or otherwise mounted to the interior of the receptacle.

The invention as disclosed herein fits a wide variety of receptacles, including, but not limited to, handbags, purses, backpacks, briefcases, suitcases, diaper bags, totes and any portable luggage item. Because of its ability to be deformed to any shape and retain that shape, the invention conforms to the shape of the receptacle's inner surface, thereby being as unobtrusive and effective as possible. Furthermore, although a rectangular lamp is shown, it is possible to make the lamp in any shape, including circles, all polygons and any irregular shape.

Although it has been disclosed that the device can be mounted in the receptacle, it is possible to leave the device detached, thereby permitting removal and placement in another receptacle. Likewise, although, when attached, it is preferred to mount the device with glue or tape that extend around the entire periphery to prevent small objects from getting trapped beneath the device, it is possible to attach it at only one side, or fewer than all sides. And although the device is disclosed as being permanently attached such as by glue, tape, stitching and other permanent mounting means, it is contemplated that the device can be temporarily attached, for example using VELCRO brand hooks and loops material, snaps, or any other temporary mounting means.

The electroluminescent lamp described above illuminates from one of its major planar surfaces, and not from the opposite major planar surface. Because of this, it is preferred that the invention be mounted to the receptacle's sidewall with the illuminating side facing into the chamber of the receptacle and the non-illuminating side facing against the sidewall of the receptacle. However, if lamps are created that illuminate from two or more sides, it is contemplated that the invention could be mounted at one edge, or in a transparent envelope mounted at an edge in the receptacle, to illuminate from both sides.

While certain preferred embodiments of the present invention have been disclosed in detail, it is to be understood that various modifications may be adopted without departing from the spirit of the invention or scope of the following claims.

The invention claimed is:

1. An illuminating apparatus for illuminating an interior of a hand-carried bag, the illuminating apparatus comprising:

(a) a flexible, light-emitting membrane;

(b) a backbone mounted to lateral edges of the light-emitting membrane, said backbone being a metal wire, retaining a deformed shape and maintaining the light-emitting membrane at the deformed shape after a force that deforms the backbone to the deformed shape is released;

(c) means for removably mounting the backbone and light-emitting membrane to the interior of the bag;

(d) a power supply electrically connected to the light-emitting membrane; and (e) a switch electrically interposed between the power supply and the membrane.

2. The illuminating apparatus in accordance with claim 1, wherein the mounting means further comprises double-sided tape mounted on a major surface of the membrane.

3. The illumination apparatus in accordance with claim 2, further comprising a flexible, light-emitting panel electrically connected to the membrane near a membrane edge.

4. The illumination apparatus in accordance with claim 2, further comprising a plurality of flexible, light-emitting panels electrically connected to the membrane near a membrane edge, with gaps formed between said membrane and said panels for forming hinges permitting angling of one panel relative to an adjacent panel.

5. The illumination apparatus in accordance with claim 2, further comprising a flexible, light-emitting panel electrically connected and removably mounted to the membrane near a membrane edge.

6. An illuminating apparatus mounted in a substantially enclosed, interior chamber of a hand-carried bag, the apparatus comprising:

(a) a flexible, light-emitting membrane;

(b) a backbone mounted to the lateral edges of the light-emitting membrane, said backbone being a metal wire, retaining a deformed shape and maintaining the light-emitting membrane at the deformed shape after a force that deforms the backbone to the deformed shape is released; and (c) means mounting the backbone and light-emitting membrane to an interior surface of the bag, (d) a power supply electrically connected to the light-emitting membrane; and (e) a switch electrically interposed between the power supply and the membrane.

7. The illuminating apparatus in accordance with claim 6, wherein the mounting means further comprises double-sided tape mounted on a major surface of the membrane and extending across said at least one malleable body.

8. A method of mounting an illuminating apparatus in an interior of a hand-carried bag, the method comprising:

(a) mounting to lateral edges of a flexible, light-emitting membrane a deformable backbone made of metal wire that retains a deformed shape and maintains the membrane at the deformed shape;

(b) applying a force to the light-emitting membrane and backbone, thereby deforming the light-emitting membrane and backbone into a non-planar shape;

(c) releasing the force;

(d) mounting the deformed backbone and the light-emitting membrane to an interior surface of the bag that has a contour substantially the same as the deformed shape of the light-emitting membrane; and (e) connecting a power supply electrically to the light-emitting membrane; and (f) interposing a switch electrically between the power supply and the light-emitting membrane.

9. The method in accordance with claim 8, wherein the mounting step further comprises adhering double-sided tape to a first major surface of the membrane and extending the tape across said at least one malleable body, and adhering said double-sided tape to an interior surface of the bag.

* * * * *